United States Patent [19]

Driscoll et al.

[11] B 3,991,091

[45] Nov. 9, 1976

[54] ORGANO TIN COMPOUND

[75] Inventors: Gary L. Driscoll, Boothwyn; Marcus W. Haseltine, Jr., Brookhaven, both of Pa.

[73] Assignee: Sun Ventures, Inc., St. Davids, Pa.

[22] Filed: Apr. 26, 1974

[21] Appl. No.: 464,587

[44] Published under the second Trial Voluntary Protest Program on February 3, 1976 as document No. B 464,587.

Related U.S. Application Data

[60] Division of Ser. No. 381,634, July 23, 1973, and a continuation-in-part of Ser. Nos. 135,295, April 19, 1971, and Ser. No. 144,165, May 17, 1971, Pat. No. 3,715,313, and Ser. No. 152,203, June 11, 1971, Pat. No. 3,793,203.

[52] U.S. Cl. ..... 260/429.7; 44/67; 252/49.7; 526/19; 260/683.15 B; 526/26; 526/241

[51] Int. Cl.[2] ..... C07F 7/22

[58] Field of Search ..... 260/429.7, 683.15 B, 260/94.8

[56] References Cited

UNITED STATES PATENTS

| | | | |
|---|---|---|---|
| 2,076,201 | 4/1937 | Langedyk et al. | 260/683.15 B |
| 2,085,535 | 6/1937 | Langedyk et al. | 260/683.15 B |
| 2,403,779 | 7/1946 | Bailey | 260/683.15 B |
| 3,190,901 | 6/1965 | Polster | 260/429.7 |
| 3,607,892 | 9/1971 | Relfenberg | 260/429.7 |

OTHER PUBLICATIONS

Chemical Abstracts, vol. 50, 15119a (1956).

Chemical Abstracts, vol. 54, 20326a (1960).

Bauer et al., J. Polymer Science, Part A-1, vol. 9, pp. 1451–1458 (1971) corresponding ref. 15 on p. 1458.

Bauer et al., Can. J. Chem. vol. 48, p. 1252 (1970).

*Primary Examiner*—Helen M. S. Sneed

*Attorney, Agent, or Firm*—J. Edward Hess; Donald R. Johnson

[57] ABSTRACT

An organo-tin compound, useful as an antiwear additive to fuels or lubricants, is obtained by polymerization of isobutylene in the presence of stannic chloride in a solvent.

6 Claims, No Drawings

ORGANO TIN COMPOUND

CROSS REFERENCES TO RELATED APPLICATIONS

This is a division, of application Ser. No. 381,634 filed July 23, 1973.

This application is a continuation-in-part of Ser. No. 135,295 filed Apr. 19, 1971, Ser. No. 144,165 filed May 17, 1971 (now U.S. Pat. No. 3,715,313 issued Feb. 6, 1973), and Ser. No. 152,303 filed June 11, 1971, now U.S. Pat. No 3,793,203, the entire disclosure of said applications being incorporated herein by reference.

Also incorporated herein by reference is the entire disclosure of U.S. Pat. No. 3,411,369 issued Nov. 19, 1968, U.S. Pat. No. 3,440,894 issued Apr. 29, 1969, U.S. Pat. No. 3,597,358 issued Aug. 3, 1971, U.S. Pat. No. 3,595,796 issued July 27, 1971, U.S. Pat. No. 3,595,797 issued July 27, 1971, U.S. Pat. No. 3,598,740 issued Aug. 10, 1971, U.S. Pat. No. 3,608,385 issued Sept. 28, 1971 and U.S. Pat. No. 3,648,531 issued Mar. 14, 1972, all of which disclose tractive or friction drives in which the present polar compounds can be used as lubricants per se or as base oils and tractive fluids (or base oils) in which the present polar compounds can be used as additives. Also incorporated herein is the entire disclosure of U.S. Pat. No. 3,619,414 issued Nov. 9, 1971, U.S. Pat. No. 3,646,224 issued Feb. 29, 1972, U.S. Pat. No. 3,560,578 issued Feb. 2, 1971 and U.S. Pat. No. 3,676,521 issued July 11, 1972, all of which disclose base oils or components of base oils in which the present polar compounds can be useful as additives.

In commonly-owned copending application Ser. No. 52,301 filed July 6, 1970 of Gary L. Driscoll, Irl N. Duling and David S. Gates, novel polyolefin and hydrogenated polyolefin oils are described which are useful as traction fluids, or as components of traction fluids. In particular, said application discloses oils consisting essentially of isobutene oligomers in the $C_{12}$–$C_{48}$ carbon number range. The novel polyolefin oils or the individual olefins therein are also disclosed as being useful as chemical intermediates to prepare novel polar components (such as alcohols, acids, esters, ketones, thioketones, amides, amines, thioesters, phosphate esters of the alcohols and thioesters). The ketones, and other non-acidic ozonolysis products are disclosed as being useful as traction fluids or as components of traction fluids. Said application also contains a declaration that such derivatives, and their use as traction fluids or as antiwear additives in lubricants are the invention of Gary L. Driscoll and Marcus W. Haseltine, Jr., the present applicants.

SUMMARY OF THE INVENTION

An organo-tin compound, useful as an antiwear additive to a fuel or lubricant, is obtained by polymerization of isobutylene in the presence of stannic chloride. The antiwear additive can be recovered from such reaction products by such means as extraction with a solvent for the tin compound.

Certain of the novel polyolefin oils of Ser. No. 52,301 consist essentially of "true isobutylene oligomers". Such oligomers are gem-structured, have crowded geminal methyl groups and are further described hereinafter. Substantially pure olefins of a single carbon number can be obtained as distillate fractions of such oils. The fractions or the oils are useful as lubricants (as for traction drives or for a controlled slip differential) and can be converted, by hydrogenation or other well known reactions, into gem-structured paraffins or polar compounds, which are useful as lubricants or components of blended lubricants.

Such reactions are disclosed, for example, in the aforementioned applications Ser. No. 52,300; Ser. No. 52,301, Ser. No. 135,295; Ser. No. 137,556; Ser. No. 144,165 and Ser. No. 152,303.

More generally, novel polyolefin oils of monomers of the formula:

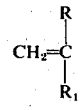

wherein R is $-CH_3$ and $-C_2H_5$ and $R_1$ is an alkyl group of from 1 to 10 carbon atoms, have exceptionally high viscosity indices and high coefficients of traction and consist essentially of unisomerized, true oligomers, such as true polyisobutylene oligomers (e.g., $C_{16}H_{32}$, $C_{20}H_{40}$, $C_{24}H_{48}$ . . . . $C_{48}H_{96}$). The novel oils are useful as electrical oils, as chemical intermediates or as tractants (i.e. as traction fluids or as components of traction fluids). The hydrogenated oils are novel and especially useful as tractants, particularly when hydrogenated to a bromine number less than 10 (more preferably, less than 5). The unique character of these novel oils, whether olefin and/or paraffin, can be proved by a combination of gas chromatography and nuclear magnetic reasonance spectroscopy (NMR). These olefins, and the paraffins produced by hydrogenation thereof, are characterized by "crowded" and sterically hindered geminal methyl and isolated methylene groups. The individual species in the range of $C_{16}$ to $C_{48}$ can be separated from the whole oil by vapor phase chromatography. One such novel polyolefin oil having an ASTM viscosity index greater than 85, consists essentially of monoolefins of carbon numbers $C_{24}$, $C_{28}$, $C_{36}$ and $C_{40}$ and having repeating isobutylene structures.

In general, improved traction fluids and components of traction fluids can be obtained by putting a polar group on a gem-structured hydrocarbon (such as the gem-structured polyisobutylenes), preferably, the compound contains no aromatic or olefinic unsaturation. The resulting polar molecule appears to be more strongly attracted to metal surfaces (compared to the parent hydrocarbon) and thus produces higher traction. That such traction fluids exhibit high traction is unexpected since the literature (see Rounds, J. Chem. & Eng. Vol. 5 (No. 4) October, 1960, and included references) teaches that hydrocarbons containing polar groups on one end reduce the static and dynamic friction of mineral oils.

For example, compounds which are useful as traction fluids or as components of traction fluids or other lubricants can be represented by the following structural formula:

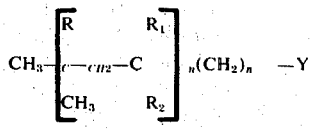

wherein $n$ is an integer from 1-30, n′ is 0 or 1, R, $R_1$ and $R_2$ are one or a combination of the following radicals: methyl, ethyl, propyl, isopropyl, butyl, isobutyl, tert-butyl, isopentyl, neopentyl, cyclohexyl, methylcyclohexyl, indanyl, hydrindanyl, cyclohexylindanyl, cyclohexyl hydrindanyl; and where Y would be any of the following functional groups: ketone, carboxylic acid, acid salts, ether, alcohol, ester, acyl halide, acyl hydrazide, mercaptan, epoxy, thioester, thiolester, thioether, phosphate (including coesters), phosphite (including coesters), sulfate, sulfite, sulfonate, halide, oxime, imine, amide, amine or maleic anhydride adduct. More than one functional group can be present in a given molecule (e.g. imine and amine). Also, the indanyl compounds and/or their cyclohexyl moieties, may be $C_{1-6}$ lower alkylsubstituted, as for example, with a methyl group. Tin complexes, as hereinafter described, are also polar compounds within the scope of this invention. With the polyisobutylene oligimers, these polar compounds can be described by the formula:

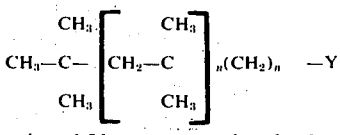

where n, n′ and Y are as previously described.

Such polar compounds are particularly useful as tractants when added in major (e.g. 50-90 volume percent) quantities or minimum effective amounts (e.g. 1 percent, more preferably 3 percent, and typically at least 6 percent) to such as paraffinic lubes (preferably solvent refined and/or dewaxed), naphthenic lubes (preferably naphthenic acid free), polyolefin fluids and synthetic (e.g. see U.S. Pat. No. 3,287,259) naphthenic lubes. All of the above-referred to base oils can be partially or fully hydrogenated to improved chemical and/or thermal stability and to permit longer periods of high traction under use conditions. Particularly useful lubricants comprise such a hydrogenated base oil which contains less than 5 weight percent of gel aromatic compounds and less than 10 weight percent of olefins and which also contains from 0.520 percent of a gem-structured polar compound, preferably, corresponding to the above formula.

In one embodiment, the present invention involves lubricant compositions comprising chemical compounds which can be produced by the action of various chemical reagents on the polyolefins or polyolefin oils. Similar reactions can be performed on other gem-substituted olefins to obtain the polar component of the present invention. Such compounds are useful as lubricant additives, particularly lubricants for tractive drives, friction drives and limited slip differentials.

One typical toric traction transmission is that described in Hewko et al., "Tractive Capacity and Efficiency of Rolling Contacts," Proceedings of the Symposium on Rolling Contact Phenomena Elsevier Amsterdam, 1962, pp. 159–161.

Circulation of the lubricant throughout the drive unit can be accomplished by spray lubrication or by splash effect. In a further embodiment, the lubricant is applied in mist or aerosol form. For mist lubrication, the lubricant can contain, to improve reclassification and/or reduce stray mist, an effective amount (e.g. 0.01–2 weight percent polymer) of a polymeric additive selected from one or a mixture of acrylic, methacrylic, olefin (e.g. isobutylene) and styrene (e.g. α-methylstyrene) polymers having a viscosity average molecular weight in the range of 10,000–2,000,000 (preferably 100,000 to 500,000). Such additives are described in the prior art. Of the above noted polar additives the more preferred are the polyolefins and the polar polyolefins (e.g. poly(methyl methacrylate)).

The substituted polybutene components of the present invention are usually liquids and have good solubility in petroleum oils. Therefore, these derivatives can be especially useful as lubricant additives or as additives to other oils, or petroleum products (such as rubber process oils, hydraulic fluids, fuels, refrigeration oils, textile machinery lubricants, coolant for a nuclear reactor, paints, etc.). By choice of the molecular weight (or viscosity) of the polyolefin starting material, the derivatives can be "tailored" to a desired viscosity or molecular weight.

DESCRIPTION OF THE DRAWING

The accompanying drawing is typical of a vapor phase chromatogram, in the $C_{16}$–$C_{32}$ region, of a novel polyisobutene oil of the present invention, and, by nearly baseline resolution (the broken line is the base line), indicates the very minor content therein of cracked, isomerized or other non-isobutene oligimer species. The vapor phase chromatogram of the same oil after hydrogenation will also be similar to that of the figure with respect to the virtual base line resolution.

Each peak in the drawing is produced by a unique hydrocarbon species (e.g. $C_{20}$), characterized by maximally "crowed" and sterically hindered geminal methyl and isolated methylene groups.

Vapor phase chromatograms of commercially available polybutene oils show that such oils do not consist essentially of true oligimers of isobutene but contain appreciable amounts of virtually all of the carbon number species which could be present within the carbon number range of the oil. For example, a commercially available polybutene oil produced distinct VPC peaks Within the $C_{16}$–$C_{29}$ range which could be identified as $C_{16}$, $C_{17}$, $C_{19}$, $C_{20}$ , $C_{23}$, etc. This oil also had far from base line resolution (i.e. an "envelope"), thus, indicating the presence of many isomeric forms of the other possible carbon number species (e.g. $C_{18}$, $C_{22}$, $C_{26}$).

The novel polyisobutylene and hydrogenated polyisobutylene oils of the present invention have a higher viscosity index (usually at least 10 percent higher) than oils of the same viscosity at 210°F prepared from polyisobutylene by prior art techniques. Although the present invention includes oils consisting essentially of isobutene oligimers in the $C_{12}$–$C_{48}$ carbon number range, the more preferred polyisobutene oils described herein, have a viscosity index in the range of 90–130 (typically at least 95) and consist essentially of true polyisobutene oligimers in the 20–40 carbon number range. As used herein viscosity index (unless specified as "ASTM") refers to Viscosity Temperature Function Viscosity Index (VTF-VI) as determined by the technique of W. A. Wright as set forth in ASTM Bulletin No. 215, 84, (1956). This value is similar to that obtained by ASTM D 2270 which is reported herein as ASTM-VI.

FURTHER DESCRIPTION

The proper selection must be made of solvent and catalyst in order to produce oligimers of the olefin starting material with a minimum of the disproportionation and isomerization that are found in oils of the prior art processes. The solvent serves as a polar solvent to solvate the intermediate carbonium ions formed during the reaction, and to complex the catalyst to give a catalytically active species which remains in the solvent phase. The nitromethane and nitroethane also dissolves appreciable amounts of monomer but little of the oils. This last property is believed to be partly responsible for the narrow molecular weight distribution obtained in the product when using these preferred solvents, which results in a more favorable product distribution. Suitable solvents for meeting the requirements for this purpose have been found to be nitromethane, nitroethane, nitropropane, nitrobenzene, benzene, lower alkyl benzenes and mixtures thereof. Suitable lower alkyl benzenes include toluene, the xylenes and ethyl benzene. Of these nitro compounds are preferred (with nitroethane being the especially preferred solvent). Reasonable yields of polyisobutylene oils having $KV_{210}$=1.5-20 and VTF-VI=95-115 can be prepared.

The preferred process for the preparation of these fluids involves the use of substantially anhydrous stannic chloride as catalysts and nitromethane (or nitroethane) as solvent. However, small amounts of water can act as reaction promoters.

The catalyst used in the preferred process (for making oils having an average molecular weight up to about 1000) is stannic chloride. The stronger Lewis acid catalyst such as aluminum chloride, aluminum bromide, titanium tetrachloride and antimony pentachloride, do not cause any appreciable polymerization of the monomers in nitromethane. Boron trifluoride in nitromethane gives an oil product from isobutene having a viscosity index of about 75. Stannic chloride does not catalyze the polymerization of these monomers satisfactorily in such solvents as ether, water, dioxane, acetic acid, acetone, acetonitrile, acetic anhydride, diethylene glycol monoethyl ether, chloroform, methyl acetate, dimethoxyethane, N-methyl-pyrolidione, and hexamethylphosphormaide.

This system is operated at low pressure near ambient temperature, gives high ratios of product to catalyst consumed, is highly selective for isobutylene while tolerating a wide variety of feed compositions, is easily controlled to give the desired products, and is well suited for continuous recycle operation.

Product isolation involves simple phase separation. The product distribution is suffciently narrow that simple vacuum topping is required so no heavy by-products are formed. By-product dimer, trimer and tetramer have some commercial uses and are also readily cracked to isobutylene for recycle.

The most important reaction variables are the temperature and the rate of feed relative to the amount of catalyst present (which determines the reaction rate).

In general the temperature can be varied from −30°C to +100°C with from −30°C to 50°C being the preferred range 0° to 35°C being an especially preferred range. Electrical oils are generally obtained at lower temperatures than those used in obtaining tractants. The volume of oil prepared is generally at least equal to the volume of solvent for a given run but the ratio of volume of oil prepared to volume of solvent present may easily exceed 10:1. When carrying out the process in a continuous operation by continuously removing the reaction medium and separating the product from the catalyst and solvent; the ratio of solvent to product generally is maintained at from 2:1 to 1:2.

The catalyst may be used in an amount equal from 0.1 to 40 volume percent of the solvent present, and preferably from 1 to 20 volume percent of the solvent present.

The concentration of the free monomer in the reaction medium is relatively small and can be controlled by the pressure maintained at given temperature for gaseous feeds, and by rate of addition for liquid olefin feeds, thus, controlling the molecular weight of the product. Generally pressures of from about 1 to 275 psi absolute have been found most suitable with from 10 to 100 psia being the preferred range.

The feed stock can vary from 5 to 100 percent vinylidene monomer (e.g. isobutylene), the remainder being any inert hydrocarbons. The presence of hydrocarbon non-vinylidene compounds is not detrimental since the vinylidene monomers as defined herein are selectively polymerized by the catalyst system. For instance, the efficiency of isobutene removal from mixtures of isobutene and other butenes and/or butanes depends on the particular process but is relatively insensitive to small amounts of impurities such as air, water, organo-sulfur or organo-nitrogen compounds.

Distillation to produce different oil compositions can give varying results depending on the vacuum, the apparatus, the distillation rate and the composition of the reaction product which is distilled. Under some conditions, considerable (>15%) trimer can be left when the oil is topped to 80°C, under other conditions little (<10%) of the trimer or tetramer will remain. More typically one-third of the tetramer remains in the oil, and two-thirds of the tetramer and nearly all of the trimer are removed. In addition, distillation is inherently limited by the thermal stability of the oil. At temperatures (of the overhead distillate) from 175° to 225°C, cracking of the oil can become so severe that the pressure starts to increase (usually the pressure is less than 1.0 mm Hg.

Vapor phase chromatograph (VPC) scans give good information on the relative amounts of dimer, trimer, etc. up to about $C_{48}$.

The oils produced by the process may have a number average molecular weight of from 224 to about 2,000. The preferred product contains principally the tetramer to decamer range. The tetramer in the present case consists predominantly of a major and a minor component. In the case of isobutene the hydrogenated major tetramer component has the structure:

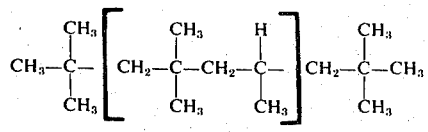

and the minor component has the structure:

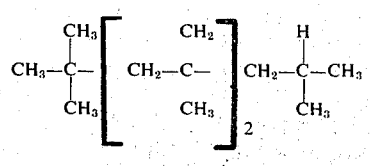

This latter type of structure predominates above the tetramer (i.e. at pentamer and above). The repeating unit for components of the pentamer and higher oligimers is indicated by the brackets in the formulae. The higher olefins such as 2-methylbutene-1 produce the corresponding regular structures when oligimerized in accordance with the previously described process conditions.

"Vinylidene" monomers suitable for preparing novel, "unisomerized" oligimer oils, by the process described herein, have the formula:

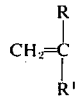

wherein —R is $—CH_3$ or $C_2H_5$ and $R^1$ is an alkyl group of from 1 to 10 carbon atoms.

These oligimers are useful in the "as produced" unsaturated forms as electrical oils. When the oils are to be used as traction fluids they may be hydrogenated using a conventional hydrogenation catalyst such as Raney nickel, platinum, palladium or rhodium to improve the oxidative stability thereof. However, the olefinic oils are relatively stable and do not require further treatment in order for them to be suitable for use as traction fluids. For most uses such as traction fluid the higher molecular weight product may be left with the tetramer to decamer range material, but the dimers and trimers should be separated therefrom along with the monomer. This is readily accomplished by distillation.

The oils as produced by the present process find particular advantage in their use as traction fluids (particularly in blends with saturated cyclic compounds) due to their high coefficients of traction and excellent viscosity-temperature properties. The requirements of a traction fluid are discussed in the U.S. Pat. Nos. 2,549,377; 3,440,894 and 3,411,369. Compounds described in the present application can be incorporated, as additives, to such prior art traction fluids. Exemplary tractive devices in which the traction fluids of the present invention find use are disclosed in U.S. Pat. Nos. 1,867,553; 2,871,714; 3,006,206 and 3,184,990.

Additionally these oils find use in caulks and as reactants, electrical oils, etc.

ILLUSTRATIVE EXAMPLES

EXAMPLE 1

A three-necked, one liter, round-bottomed flask was equipped with a mechanical stirrer, a gas inlet tube (which also serves for intermittent product removal), and a reflux condenser containing a thermometer which dipped into the liquid layer and was capped with a gas exit tube leading through a mercury bubbler to the atmosphere. Nitromethane (200 ml.) and stannic chloride (5 ml. = 11.15 g.) were added to the flask and the isobutylene flow started. The reaction was maintained at 3±1°C with an ice bath. The rate of isobutylene addition as 7.2 g/min. which resulted in 8.5 ml/min. of product (density about 0.85) formation. At 20 minute intervals, the isobutylene feed and the stirrer were stopped and the layers permitted to separate. The top oil layer (170 ml.) was removed and the nitromethane (bottom) layer was returned to the reactor with 5 ml. (3 percent of product volume) fresh nitromethane added to compensate for solubility losses. After four twenty-minute runs, the reaction was stopped. The catalyst in the nitromethane layer was readily killed with water with some production of HCl fumes. No difficulty with an exotherm was encountered when killing the catalyst. The combined oil layers (665 ml. including 20 ml. nitromethane) were washed with water, with 5 percent sodium hydroxide solution, and twice more with water. A solvent such as pentane or hetane can be added to facilitate handling.

Although the oil of this example contains all of the novel polyisobutylene oligimers in the series $C_{16}$–$C_{20}$. . . $C_{48}^+$, fractional vacuum distillation can be used to obtain a fraction relatively pure in a given oligomer (e.g. $C_{16}$).

In the reaction of this example, small amounts of water in the catalyst and/or feed material can act as a reaction promoter. If extremely pure materials are used in the process, a small amount of water can be added to initiate or hasten the reaction. A lower alcohol (e.g. methanol) or acid (e.g. acetic acid) can also be used as such a promoter. Generally, the reaction rate can be increased (over anhydrous) by addition of 0.1–1.5 moles $H_2O$ per mole of $SnCl_4$.

Polyolefin products, such as that of this example, can contain residual tin and chlorine (e.g. 250–5000 ppm Cl). As is discussed in more detail hereinafter, these elements, particularly the tin, can be present as a metal-organic compound which imparts EP (extreme pressure lubricant) properties to the product. However, if one desires, the chlorine (e.g. 2000 ppm) can be removed from the product by heating the product with calcium oxide (lime) followed by filtration. Mild catalytic hydrogen treatment (e.g. 200 psi of $H_2$, 200°C, Harshaw NI-0104P catalyst) can also be used to reduce the tin and chlorine content to very low levels (e.g. Cl from 2000 ppm to 6 ppm).

Any of the polar compounds described herein perform as a traction improving additive in any petroleum oil (paraffinic or naphthenic), including oils produced by hydrocracking, or any compatible synthetic fluid (silicones, ester oils, polyolefins, fluorinated fluids).

The polar compounds can be used as extreme pressure additives and/or wear additives. The polar end of the molecule is apparently strongly attracted to the metal surface, resulting in less wear of the surface due to the protective action of the gem-structured "backbone."

EXAMPLE 2

The reaction product of Example 1 contains substantial amounts of tin and chlorine. More probably, the tin and chlorine are chemically combined, in a highly soluble and compatible form, with one or more isobutylene oligimers. In any event, the recovered polyisobutylene oil can also contain such tin and chlorine. Such a novel tin and/or chlorine containing polyisobutylene oil has improved antiwear properties (e.g. a 4-ball tester "wear-scar" in the order of 0.4 to 0.6 mm compared to about 0.75 mm. for a solvent refined parafinnic lube of comparable viscosity). Chemical derivatives (such as those of the parent application Ser. No. 381,634) can also exhibit improved antiwear properties, which can be caused in whole or in part by inclusion of such tin and chlorine or, perhaps, the improved antiwear properties may be, in whole or in part, an inherent property of said derivative.

An antiwear additive (e.g. for incorporation in conventional naphthenic distillate oils, hydrorefined oils, hydrocracked oils, white oils, solvent refined paraffinic oils or mixtures of two or more such oils) can be obtained from such reaction products (or tin and chlorine containing oils) by such means as extraction with a solvent (preferably acetone) for the presumed organo tinchlorine complex. Preferred solvents comprise acetone, ethanol, methanol, methyl ethyl-ketone, dimethyl formamide, furfural, nitromethane, nitroethane, and the like; that is, solvents which will not dissolve the oil but will dissolve the more polar complex. Readily detectable antiwear protection is provided by such additives at concentration levels which impart 100 parts of tin per million parts of oil, with a typical range being 50 ppm. to 10 weight percent of tin.

Therefore, one aspect of the present invention is novel lubricating oil additives comprising the tin-containing products of the polymerization of isobutylene using stannic chloride catalyst, such polymerizations being carried out between −80°C and 100°C at a pressure from 0-250 psia. These additives can contain from .005 to 50 weight percent tin.

These compositions can also be used as additives to fuels (e.g. diesel oil, gasoline and jet fuel) to prevent wear.

A one-liter round bottom three-necked flask equipped with a mechanical stirrer and a thermometer was charged with nitroethane (200 ml.) and stannic-chloride (5 ml. = 11.2 g.). The temperature was maintained at 30°C with an external ice bath while isobutylene was bubbled in for one hour. After this time the stirring was stopped and the upper oil layer (530 ml.) was separated from the lower nitroethane layer (160 ml.). After water washing and drying over calcium chloride, the oil layer was distilled to get a fraction boiling up to 82°C at 2 mm. Hg (which was discarded), a fraction boiling from 82°C at 2 mm. Hg to 175°C at 1 mm. Hg, $KV_{210°F}$ = 18.14 cSt.

In the same equipment, except that the flask had a volume of 500 ml., the charge was nitromethane (200 ml.) and stannic chloride (20 ml. = 44.6 g.). The temperature was maintained at 15°C for 21 minutes at the same rate of isobutylene addition used before. The upper layer was washed with water and dried over calcium chloride. It was then distilled to remove distillate boiling up to 80°C at 1 mm. Hg. pressure. The remaining oil residue ($KV_{210°F}$ = 46.74 cSt) was saved for wear testing.

In the same equipment, the charge was nitromethane (200 ml.), pentane (200 ml.), stannic chloride (20 ml. = 44.6 g.) and water (150 microliters). The temperature was maintained at −10°C for one hour at the same rate of isobutylene feed. The mixture was allowed to stir for an additional 30 minutes. The oil product was washed and dried over calcium chloride. The pentane was removed under aspirator vacuum and the product distilled to a boiling point of 80°C at 1 mm. Hg, the small amount of the distillate being discarded. The bottoms ($KV_{210°F}$ about 420 cs) yield was about 500 ml. It contained 4.5 percent tin and 2.5 percent chlorine after filtration through diatomaceous earth at 80 to 100°C. This oil (100 ml.) was extracted three times with acetone (25 ml. each time). The extracts were combined and the acetone was removed by heating to 90°C under a stream of nitrogen. The extracted oil, about 90 ml., and the extract, 10 ml. had similar viscosities. The initial oil had 4.6 percent tin; the extracted oil had 1 percent tin; and the extract 33 percent tin. This oil and the extract, as with the other tin-containing products referred to above, can be added to lubricants to impart antiwear properties thereto.

Methods for analysis of the branched olefin and paraffin oils described herein (as in Example 1) can be found in J. Poly. Sci, part A-1,volume 9, pp. 717–745 (March 1971).

EXAMPLE 3

Nitromethane (200 ml.) and $SnCl_4$ (5 ml.) are stirred in a three-necked, round-bottomed flask (500 ml.) equipped with a gas inlet tube, mechanical stirrer, reflux condenser, external bath and thermometer, while isobutene is passed into the mixture kept at 36°C. The isobutene is feed to the flask at a rate sufficient to maintain no flow on the outlet side after air has been swept from the flask. After 26 minutes the isobutene flow is stopped and the contents of the flask transferred to a separatory funnel. Conversion of the isobutene is quantative. After allowing 5 minutes for phase separation, the nitromethane layer (202 ml.) is drained from the bottom of the funnel. The oil layer (235 ml.) is washed twice with saturated aqueous sodium chloride solution, once with 5 percent aqueous sodium chloride solution and twice more with saturated aqueous sodium chloride solution. The oil layer is then dried over anhydrous calcium chloride and placed in a vacuum istillation apparatus. It is distilled to remove all material boiling below 80° at 0.5 mmHg. The remaining oil fraction (100 ml.) has the following properties:* $KV_{210°F}$ = 4.25 cs, $KV_{100°F}$ = 22.42 cs, VTF-VI = 98 ASTM-VI = 104. The distillate (100 ml.) was approximately (by VPC) 49 percent trimer and 49 percent tetramer. Any dimer would have been lost to the trap (10 ml.). The loss on batch drying is about 30 ml.

* as used herein KV stands for Kinematic Viscosity as determined by ASTM D 445

EXAMPLE 4

Example 3 was repeated except that the oil was distilled, collecting as the oil fraction the portion boiling from 80° to 200°C. This had the following properties: $KV_{210°F}$ = 3.23 cs, $KV_{100°F}$ = 14.09 cs, VTF-VI = 105, ASTM-VI = 104. This illustrates that the high viscosity index of the product is not due to a wide blending range of product molecular weight.

EXAMPLE 5

A polymerization is carried out as in Example 3 except that the reaction temperature is maintained at 25°C. Again, 235 ml. of product is obtained in 26 min. The distllation gives 33 ml. of low boiling distillate (40 percent trimer, 57 percent tetramer) and 188 ml. remaining oil. This oil is percolated through about 12 in. of a column packed with activated alumina. The resulting oil is completely clear and has the following properties: $KV_{100°F}$ = 13.56 cs, $KV_{100°F}$ = 145.2 cs, VTF-VI = 96, ASTM-VI = 96.

Any of the polyolefin oils of the present invention can be partially or fully hydrogenated by known methods (e.g. palladium on charcoal catalysts, 2500 psi hydrogen, at 274°C) to improve their stability. The polyolefin oils or hydrogenated oils can be fractionally distilled under vacuum at from 40 to 250°C. Distillate fractions covering the complete boiling range can be taken as feed stocks from which individual hydrocarbon species (olefins or paraffins) can be recovered.

The identity of these branched hydrocarbons, as determined by MNR spectroscopy, are indicated by the structural assignments shown in J. Poly. Sci. part A-1, Volume 9, pp. 717 to 745 (March, 1971). The observed resonance positions in $CCl_4$ and assignments for the methylene and methyl protons of this series of hydrocarbons are summarized in the above paper. Methyl and methylene protons of the same type and having the same degree of steric hinderance and "crowding" were found to have essentially the same chemical shifts in $CCl_4$ for each individual hydrocarbon species regardless of carbon number. Differentiation and assignment of a number of the maximally "crowded" methylene and maximally "crowded" geminal dimethyl groups in these compounds was possible from 100-MHz spectra obtained using $C_6D_6$ solvent. The observed proton resonance positions for these groups in $C_6D_6$ and their assignment in the $C_{19}$ to $C_{40}$ hydrocarbon species are summarized in the above paper.

Substantially pure olefin species can be obtained and characterized in a similar manner from the unhydrogenated polyisobutylene oils.

The novel branched paraffin and olein hydrocarbon species are characterized by "crowded" and sterically hindered methyl and methylene groups. This crowding effect, although somewhat less pronounced in the lower carbon number species, becomes significantly greater with an increase in the carbon chain. The introduction of methylenes between two internal geminal methyl groups or between an internal geminal methyl and a t-butyl group ($\gamma$ to each group) causes significant bending of the hydrocarbon chain. This bending results in much greater "crowding" and steric hinderance of the various protons which in turn restrict free rotation of the individual methylene and geminal methyl groups. Resulting anisotropy changes cause a downfield chemical shift of their proton resonance signals.

The lower limit of this downfield shift in branched paraffins ($CCl_4$ solutions) is 66 Hz (1.10 ppm) for internal geminal methyls and 85 Hz (1.42 ppm) for isolated methylenes. This occurs in the polymer, polyisobutylene, where the repeating isobutylene unit provides maximum "crowding" of both the geminal methyl and the isolated methylene groups. The lower carbon number, $C_{11}$, $C_{12}$ and $C_{15}$, branched hydrocarbon species have no maximally "crowded" geminal methyl groups.

The $C_{16}$ hydrocarbon species is characterized by having both "crowded" and maximally "crowded" geminal methyl groups. This is the first molecular species in this series of compounds which has maximum "crowding" of a geminal methyl group. A geminal methyl group has maximum "crowding" when it is (1) adjacent, $\alpha$, to two isolated methylene groups and (2) beta, $\beta$, to two quaternary carbon atoms. This "crowding" is comparable to the maximum "crowding" of geminal methyls of high molecular weight (e.g. 200,000+) polyisobutylene. The resonance signal for the maximally "crowded" geminal methyl, like the resonance signal for the maximally "crowded" geminal methyls of polyisobutylene, is shifted downfield and appears at 65–66 Hz (1.08-1.10 ppm). The two isolated methylenes in this molecule (referred to as the terminal isolated methylenes in the longer carbon chain species) are both adjacent to a maximally "crowded" geminal methyl group and are, therefore, more sterically hindered and "crowded" than the isolated methylenes of the $C_{12}$ and $C_{15}$ species. This increased methyl "crowding" causes a 5 Hz downfield shift of the methylene resonance to 80 Hz (1.33 ppm), where one single resonance peak is observed for both isolated terminal methylene groups. These methylene groups, are defined as "crowded" methylenes and are found in all of the higher carbon number species ($C_{16}$ and above).

The $C_{19}$ hydrocarbon species is the only other compound in this series which has a single maximally "crowded" geminal methyl group. This molecular species, which is symmetrical about the maximally "crowded" geminal methyl group, has two isolated methylenes, having exactly the same molecular environment. These groups are, therefore, magnetically equivalent. The NMR spectrum of the $C_{19}$ species in both $CCl_4$ and $C_6D_6$ solvents show a single proton resonance peak for these "crowded" methylenes. All of the odd carbon numbered species in this series are characterized by this molecular symmetry and have terminal isolated "crowded" methylene groups which are identical. The unsymmetrical $C_{20}$ hydrocarbon species is the first species of this hydrocarbon series which has a maximally "crowded" methylene group. An isolated methylene group has maximum "crowding" when it is adjacent to, or between, two maximally "crowded" geminal methyl groups such as in polyisobutylene.

The subsequent higher carbon numbered novel hydrocarbons ($C_{23}$ to $C_{40}$) have an increasing number of maximally "crowded" geminal methyl and maximally crowded methylene groups, and consist of two basic species (1) and odd carbon numbered species terminated with two isopropyl groups and symmetrical about either a maximally "crowded" geminal methyl group or a maximally "crowded" methylene groups and (2) an even carbon numbered species terminated with both an isopropyl and t-butyl group and without a center of symmetry. The $C_{23}$ and $C_{24}$ species are illustrated below where A refers to maximally "crowded" geminal methyl groups and B corresponds to maximally "crowded" methylene groups.

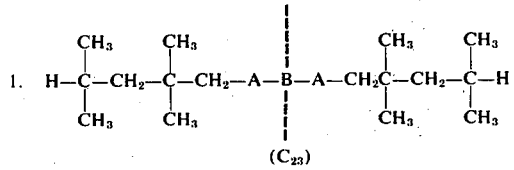

and

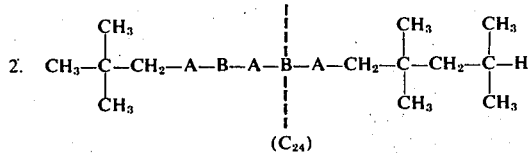

Integrated intensities of the observed resonance for each carbon number species were consistent for the theoretical number of maximally "crowded" methylenes and maximally "crowded" geminal methyls predicted for each assigned structure. The number of maximally "crowded" methylene groups is always one less than the number of maximally "crowded" geminal methyl groups. Further details of the characterization of compounds containing side groups can be found in the J. Poly. Sci. paper.

The invention claimed:

1. An organo-tin compound, useful as an antiwear additive to a fuel or lubricant, recovered from the reaction product obtained by polymerization of isobutylene in the presence of from 0.1–40 volume percent of a metal halide consisting essentially of stannic chloride in a solvent selected from nitromethane, nitroethane, nitropropane, nitrobenzene, benzene, lower alkyl benzenes and mixtures of two or more said solvents at a temperature in the range of −80 to +100°C.

2. The compound of claim 1 and containing in the range of 0.005 to 50 weight percent tin which is chemically combined with the organic portion of said compound.

3. The compound of claim 1 and containing chemically combined chlorine.

4. The compound of claim 3 and containing at least 2000 ppm chlorine.

5. The compound of claim 1 which has been recovered by solvent extraction of said reaction product with a solvent which will not dissolve the oil but which dissolves the tin compound.

6. The compound of claim 5 wherein said extraction is with acetone, ethanol methanol, methyl ethyl ketone, dimethyl formamide, furfural, nitromethane or nitroethane.

* * * * *